United States Patent [19]

Hsu

[11] Patent Number: 4,502,603

[45] Date of Patent: Mar. 5, 1985

[54] FEEDING BOTTLE

[76] Inventor: Shen-Kuang Hsu, 6-1, La. 168, Chi Lin Rd., Taipei, Taiwan

[21] Appl. No.: 575,645

[22] Filed: Jan. 31, 1984

[51] Int. Cl.[3] ..... A61J 9/00

[52] U.S. Cl. ..... 215/11 C

[58] Field of Search ..... 215/11 C, 11 R; 220/90.2

[56] References Cited

U.S. PATENT DOCUMENTS 2,493,380 1/1950 Bailey ..... 215/11 C

*Primary Examiner*—Donald F. Norton

*Attorney, Agent, or Firm*—Armstrong, Nikaido, Marmelstein & Kubovcik

[57] ABSTRACT

The present invention relates to a feeding bottle, and in particular to one which has a container provided with threads at its upper portion, a collar threadedly engaged with the container, a mouthpiece fixedly attached on the collar, and a cap selectively engageable with the top and bottom of the collar.

1 Claim, 3 Drawing Figures

FEEDING BOTTLE

BACKGROUND OF THE INVENTION

The type of the invention referred to is well known in the art which generally comprises a container, a mouthpiece engageable with the container and a cap served for covering the mouthpiece. Nevertheless, the volume of the feeding bottle is constant so that it is often necessary to prepare a small-sized feeding bottle in addition to the normal-sized feeding bottle. The small-sized feeding bottle is used for feeding liquids such as juice, or the like to the infant while the normal-sized feeding bottle is used for feeding milk or the like to the infant. Accordingly, it is necessary to prepare at least two feeding bottles for an infant. Furthermore, it will cause much inconvenience when carrying the infant outside.

SUMMARY

It is a primary object of the present invention to provide a feeding bottle which may be used as two feeding bottles of different volumes.

It is another object of the present invention to provide a feeding bottle which is inexpensive to manufacture.

It is still another object of the present invention to provide a feeding bottle which is convenient to carry.

Other objects and merits and a fuller understanding of the present invention will be discerned by those having ordinary skill in the art when the following detailed description of the best mode contemplated for practicing the invention has been read in conjunction with the accompanying drawings wherein like numerals refer to like or similar parts and in which:

DETAILED DESCRIPTION OF THE PREFERRED EMBODIMENT

Figure 1:
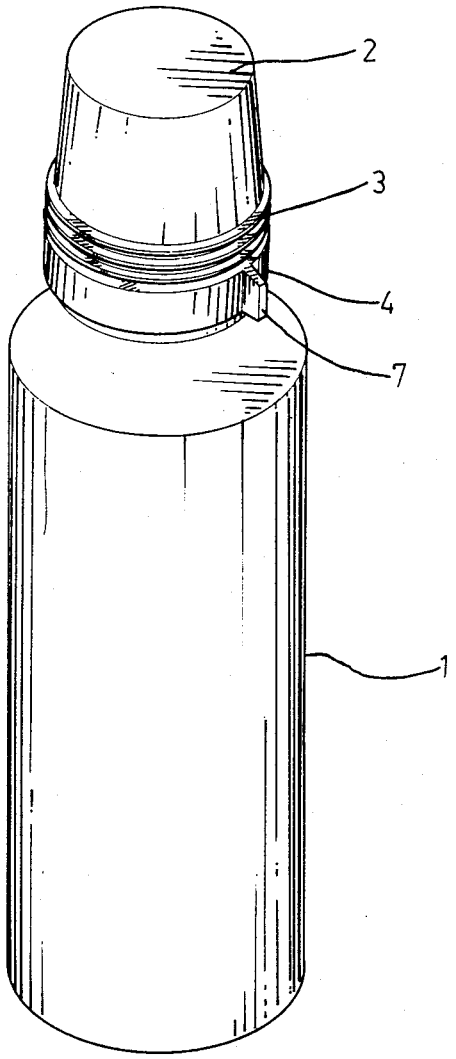
FIG. 1 is a perspective view of a feeding bottle embodying the present invention.
Figure 2:
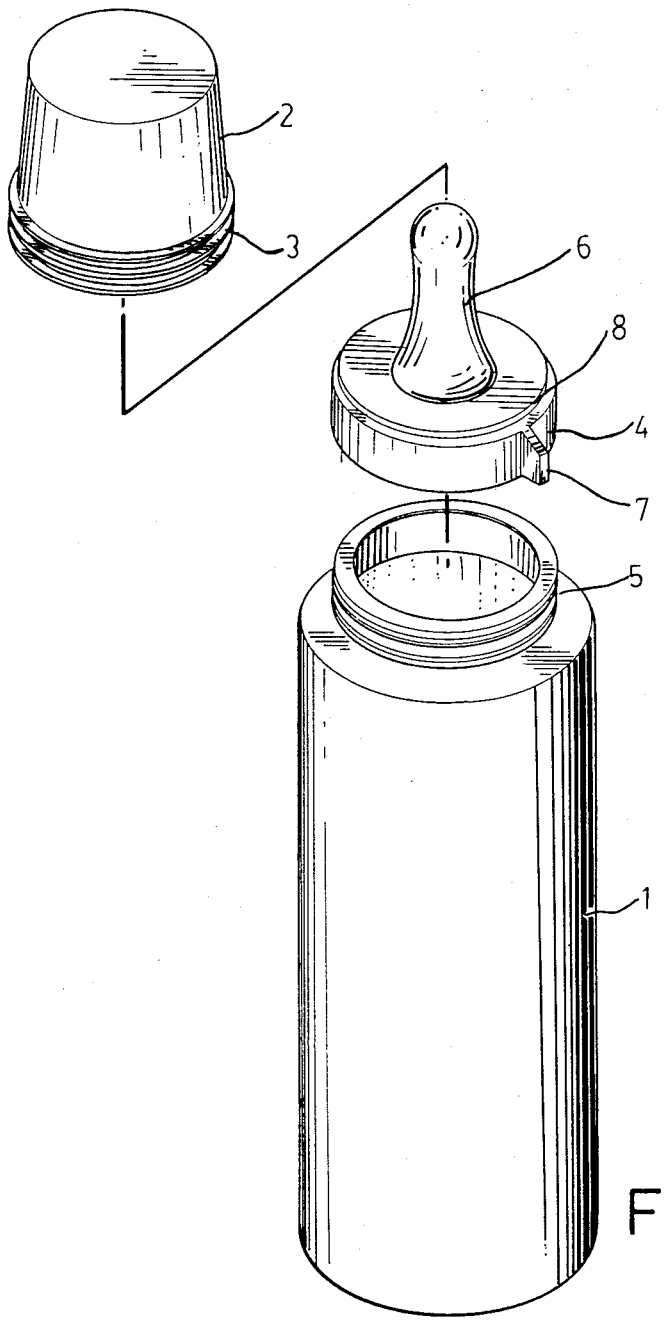
FIG. 2 is a fragmentary perspective view of the feeding bottle.
Figure 3:
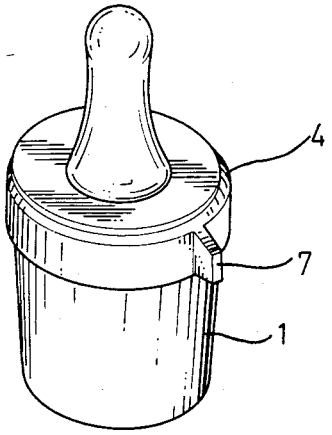
FIG. 3 shows how the present invention is used as a small-sized feeding bottle.

With reference now to the drawings and in particular to FIG. 1 thereof, there is shown a perspective view of a feeding bottle according to the present invention. The feeding bottle comprises a container (1) which may be shaped as desired. The top of the container (1) is provided with external threads (5). A collar (4) having internal threads (9) (not shown) is engaged with the threads (5) of the container (1). On the top of the collar (4) is a rubber mouthpiece (6) whereby the infant may get the milk or the like from the container (1). A protuberance (7) is provided on the vertical side of the collar (4) for facilitating the manual rotation thereof. The collar (4) is covered with a cap (2) at its edge (8). The cap (2) is provided with external threads (5) which are designed so that cap 2 may engage with the internal threads (9) (not shown) of the collar (4), as shown in FIG. 3.

When necessary to feed a normal amount of milk or the like to an infant, it is only necessary to engage the collar (4) with the container (1) to form a normal-sized feeding bottle. When necessary to use a small-sized bottle to feed an infant a small amount of liquid such as, juice or the like, first dismantle the collar (4) from the container (1) and then engage the collar (4) with the cap (2) to form a small-sized feeding bottle.

Although this invention has been described with a certain degree of particularity, it is understood that the present disclosure has been made by way of example only and that numerous changes in the detail of construction and the combination and arrangement of parts may be resorted to without departing from the spirit and scope of the invention as hereinafter claimed.

I claim:

1. A feeding bottle comprising:

a container provided with threads at its upper portion;

a collar threadedly engaged with said threads of said container;

a mouthpiece fixedly attached to said collar; and a cap mounted on the top of said collar, said cap having threads engageable with the bottom of said collar;

whereby said cap is used as a container when engaged with the bottom of said collar thereby enabling said feeding bottle to be used as two feeding bottles of different volumes.

* * * * *